US006838618B2

(12) United States Patent
Newbold et al.

(10) Patent No.: US 6,838,618 B2
(45) **Date of Patent: *Jan. 4, 2005**

(54) FIRE ASSEMBLY FOR RECESSED ELECTRICAL FIXTURES

(75) Inventors: Ronald Newbold, Roebuck, SC (US); Thomas T. White, Fayetteville, GA (US)

(73) Assignee: Hubbell Incorporated, Orange, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/702,725

(22) Filed: Nov. 7, 2003

(65) Prior Publication Data

US 2004/0090772 A1 May 13, 2004

Related U.S. Application Data

(63) Continuation of application No. 10/066,310, filed on Feb. 1, 2002, which is a continuation-in-part of application No. 09/520,382, filed on Mar. 8, 2000, now Pat. No. 6,357,891.

(51) Int. Cl.[7] ..... H02G 3/08; H05K 5/00

(52) U.S. Cl. ..... 174/50; 174/17 VA; 174/48; 362/365; 362/147; 52/27

(58) Field of Search ..... 174/50, 65 R, 174/57, 53, 48, 17 VA; 220/3.2, 3.3, 3.9, 4.02; 248/317, 906, 343; 52/27, 220.1; 362/147, 148, 150, 365; 361/600

(56) References Cited

U.S. PATENT DOCUMENTS

| | | | |
|---|---|---|---|
| 2,717,955 | A | 9/1955 | Schwemmer |
| 3,915,777 | A | 10/1975 | Kaplan |
| 4,069,075 | A | 1/1978 | Billing et al. |
| 4,093,818 | A | 6/1978 | Thwaites et al. |
| 4,210,070 | A | 7/1980 | Tatum et al. |
| 4,219,307 | A | 8/1980 | Bergdahl |
| 4,237,671 | A | 12/1980 | Munson et al. |
| 4,276,332 | A | 6/1981 | Castle |
| 4,375,142 | A | 3/1983 | McDonald |
| 4,400,673 | A | 8/1983 | Gilman |
| 4,400,766 | A | 8/1983 | Munson |
| 4,574,454 | A | 3/1986 | Dyson |
| 4,751,624 | A | 6/1988 | Russo et al. |
| 4,930,054 | A | 5/1990 | Krebs |
| 5,103,609 | A | 4/1992 | Thoreson et al. |
| 5,222,800 | A | 6/1993 | Chan et al. |
| 5,351,448 | A | 10/1994 | Gohlke et al. |
| 5,373,431 | A | 12/1994 | Hayman et al. |
| 5,404,687 | A | 4/1995 | Blake et al. |
| 5,440,471 | A | 8/1995 | Zadeh |
| 5,457,617 | A | 10/1995 | Chan et al. |

(List continued on next page.)

FOREIGN PATENT DOCUMENTS

| | | |
|---|---|---|
| GB | 2235710 | 3/1991 |
| GB | 2270936 | 3/1994 |
| GB | 2321515 | 7/1998 |

*Primary Examiner*—Dean A. Reichard
*Assistant Examiner*—Angel R. Estrada
(74) *Attorney, Agent, or Firm*—Mark S. Bicks; Alfred N. Goodman

(57) ABSTRACT

A fire assembly that can be used for installing recessed electrical fixtures into various structures such as wall assemblies is provided. The fire assembly includes an electrical fixture contained within a generally fire-resistant housing. The housing can enclose the electrical fixture in such a manner that the resulting fire assembly has an integral structure. In some instances, a support structure can be utilized to attach the housing to the electrical fixture. Furthermore, the housing can be a cube-shaped box have a variety of generally fire-resistant walls. These walls can be made from materials such as sheet rock.

34 Claims, 11 Drawing Sheets

U.S. PATENT DOCUMENTS 5,546,711 A 8/1996 Heller
5,548,499 A 8/1996 Zadeh
5,562,343 A 10/1996 Chan et al.
5,567,041 A 10/1996 Slocum
5,588,737 A 12/1996 Kusmer
5,758,959 A 6/1998 Sieczkowski
5,823,664 A 10/1998 Demshki, Jr. et al.
5,857,766 A 1/1999 Sieczkowski
6,004,011 A 12/1999 Sieczkowski
6,079,856 A 6/2000 Prestier
6,082,878 A 7/2000 Doubek et al.
6,105,334 A 8/2000 Monson et al.
6,123,435 A 9/2000 Wang
6,123,438 A 9/2000 Hentz
6,168,285 B1 1/2001 Flohre
6,176,599 B1 1/2001 Farzen
6,263,619 B1 7/2001 Gretz
6,272,794 B1 8/2001 Rippel et al.
6,276,818 B1 8/2001 Wang
6,286,980 B1 9/2001 Meyer
6,309,190 B1 10/2001 Chen
6,357,891 B1 * 3/2002 Newbold et al. ..... 362/147
6,474,846 B1 11/2002 Kelmelis
6,514,054 B1 2/2003 Liu
6,533,559 B2 3/2003 Hsieh
6,561,762 B1 5/2003 Horng et al.
6,632,006 B1 * 10/2003 Rippel et al. ..... 362/365

* cited by examiner

| TC NOS. | LOCATION |
|---|---|
| 1-3 | ON BOTTOM FACE OF WOOD JOIST BETWEEN WOOD JOIST AND WALLBOARD |
| 4-15 | ON WOOD JOIST FACE AT MIDHEIGHT |
| 16-21 | ON UNDERSIDE OF PLYWOOD FLOORING |
| 22-30 | ON FIXTURE WITHIN JOIST CAVITY |
| 31-36 | ON UNEXPOSED SURFACE |

THERMOCOUPLE LOCATIONS

FIRE ASSEMBLY FOR RECESSED ELECTRICAL FIXTURES

The present application is a Continuation of U.S. patent application Ser. No. 10/066,310, filed Feb. 1, 2002, which is a Continuation-In-Part application Ser. No. 09/520,382, now U.S. Pat. No. 6,357,891 filed on Mar. 8, 2000, the entire contents of both of which are incorporated herein by reference.

FIELD OF THE INVENTION

The present invention generally relates to a fire assembly that can be used to install recessed electrical fixtures into various structures.

BACKGROUND OF THE INVENTION

Current residential buildings, such as apartments, assisted living housing developments, or condominiums, can be constructed in a variety of ways. Regardless of the manner of construction, however, the building must generally comply with certain fire safety standards, such as set forth by Underwriters Laboratories ("UL"). For example, wood joists and sheet rock are typically used to create a residential-like atmosphere. When using such materials, the building structure must typically satisfy a specific UL "fire-rated" assembly standard. For example, one applicable test is UL=s 1 hr. Fire Rated L-500 Floor-Ceiling Assembly test. This test measures and rates a given floor-ceiling assembly for fire safety compliance.

Very often, it is desired to install various accessories into building structures. For example, recessed electrical fixtures, such as recessed lighting fixtures, are commonly installed into residential and commercial building structures. A recess lighting fixture typically includes a light element surrounded by a light housing, often referred to as a "can". When installing a recessed lighting fixture, a hole must generally be cut into the surface. Once the hole is cut, the recessed lighting fixture can be attached to a joist or other support member behind the surface. As a result, the lighting fixture becomes recessed behind the surface to distribute light therefrom.

However, one problem associated with installing recessed electrical fixtures in such a manner is that the hole cut in the surface can change the fire safety requirements of the assembly. For example, ceiling structures are typically tested by UL prior to installing such recessed electrical fixtures. By cutting a hole in the ceiling, a non-continuous surface can result and the floor-ceiling assembly may no longer satisfy certain fire safety standards.

To overcome this problem, current builders have begun to fabricate separate boxes ("fire boxes") around the recessed lighting fixtures just prior to installation to create a continuous ceiling surface. Most building inspectors interpret such a continuous ceiling surface as complying with all applicable fire standards. However, because these fire boxes are unattached and must be fabricated by the builder separately from the lighting fixture, a substantial amount of additional time and expense can be incurred. Moreover, because most builders are unaware of what size box is required for fire safety, exceedingly large boxes have often been utilized, causing unneeded cost and expense.

SUMMARY OF THE INVENTION

The present invention recognizes and addresses the foregoing problems and others experienced in the prior art.

The present invention is generally directed to a fire assembly that includes a recessed electrical fixture. In one embodiment, the recessed fixture can be a light fixture and can include a lamp, such as incandescent or fluorescent lamps, enclosed within a light housing or "can". The light housing can have a generally cylindrical shape and be configured such that a lamp contained therein can distribute light from the housing. Examples of suitable recessed light fixtures are disclosed in U.S. Pat. No. 5,758,959 to Sieczkowski; U.S. Pat. No. 5,857,766 to Sieczkowski; and U.S. Pat. No. 6,004,011 to Sieczkowski, which are all incorporated herein by reference.

According to the present invention, the fire assembly can also include a housing that encloses the recessed light fixture. In general, the housing, or fire box, can have any desired shape or size, so long as the housing is capable of providing a continuous fire wall when installed into a wall assembly or a floor-ceiling assembly (e.g. a ceiling surface). A continuous surface can result when the housing is placed behind an opening in the surface of a ceiling or wall such that the opening is substantially covered by the housing. For instance, in one embodiment, the housing can comprise a cube-shaped box having a plurality of side walls and a top wall. In another embodiment, the cube-shaped box can also include a bottom wall. The bottom wall can, in some embodiments, define a hole that corresponds to the hole cut into the surface.

Typically, a housing of the present invention is generally fire-resistant such that it can impart some fire protection to the recessed lighting fixture and maintain the fire rating of the floor-ceiling assembly or the wall assembly. For example, in one embodiment, a housing wall can contain at least one generally fire-resistant material. Examples of generally fire-resistant materials include, but are not limited to, dry wall or wallboard (e.g. sheet rock, plywood, asbestos cement sheets, gypsum plasterboard, laminated plastics, etc.), and plaster. In some embodiments of the present invention, the housing walls can contain more than one layer of material. For instance, in one embodiment, each housing wall can contain two layers of sheet rock material. Moreover, in other embodiments, other materials can also be attached to the generally fire-resistant materials. For instance, in one embodiment, each housing wall can contain an outer layer of sheet rock material attached to an inner layer of aluminum.

In general, any suitable method of attachment can be utilized to attach various walls and/or wall layers in accordance with the present invention. For instance, in one embodiment, an outer layer of sheet rock can be mechanically attached (e.g. screws) to an inner layer of aluminum to form one housing wall. In another embodiment, an outer layer of sheet rock can be adhesively attached to an inner layer of sheet rock to form a housing wall. Furthermore, in other embodiments, the walls can be attached using various attachment methods, such as mechanical or adhesive methods. For example, in one embodiment, a top wall can be adhesively attached to four side walls to form a cube-shaped fire box of the present invention.

In accordance with the present invention, various mechanisms can be utilized to connect the housing to the recessed light fixture such that an integral structure can be formed. For example, in one embodiment, a support structure can be provided to attach to both the recessed light fixture and the housing. In particular, a support structure, such as a metal frame, can first be attached to the outer surfaces of the recessed lighting fixture. Thereafter, the housing can be attached to the support structure such that an integral structure is formed by the attachment of the recessed light fixture, support structure, and housing. When attaching the support structure to the housing or recessed light fixture, any method of attachment known in the art, such as described above, can be utilized. It should be understood that various other mechanisms can be utilized to connect the recessed light fixture to a housing of the present invention. Moreover, in some embodiments, the recessed light fixture can be directly attached to the housing to form a fire assembly having an integral structure.

In some embodiments, a fire assembly of the present invention can also include a junction box for wiring the recessed light fixture. For instance, in one embodiment, the junction box can be contained within the housing. Moreover, in another embodiment, the junction box can be positioned outside the housing on a portion of the bottom wall of the housing extending beyond the intersection of the bottom wall and one of the side walls. Regardless of the position of the junction box, at least one conduit can be provided that can extend from the junction box to another conduit of another fire assembly or recessed light fixture. Consequently, such a conduit(s) can allow a fire assembly of the present invention to be easily connected to various other light fixtures within a building structure.

Other objects, features and aspects of the present invention are discussed in greater detail below.

BRIEF DESCRIPTION OF THE DRAWINGS

A full and enabling disclosure of the present invention, including the best mode thereof, directed to one of ordinary skill in the art, is set forth in the specification, which makes reference to the appended drawings, in which.

Figure 1:
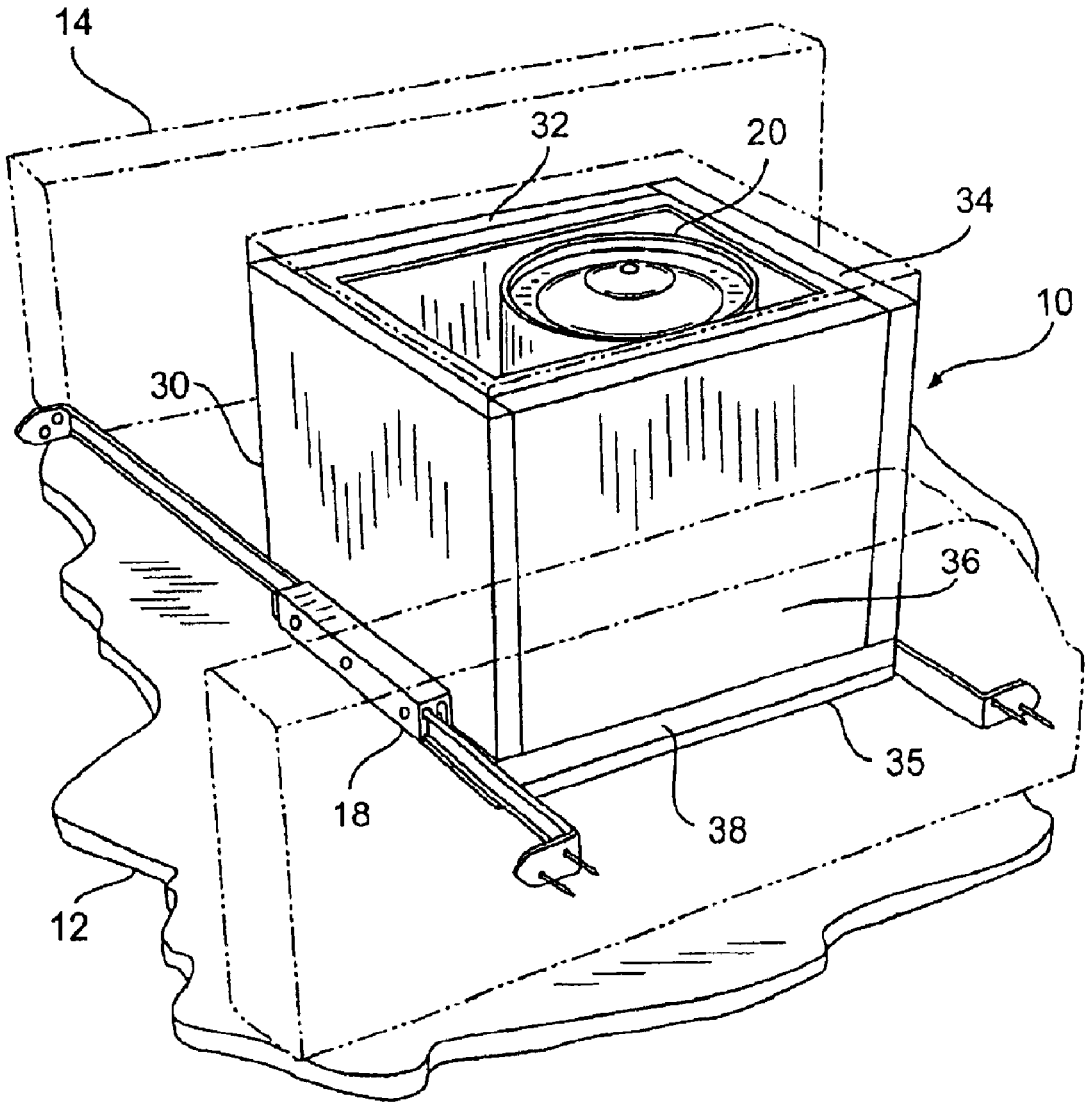
FIG. 1 is a perspective view of one embodiment of a fire assembly of the present invention.

Repeat use of reference characters in the present specification and drawings is intended to represent the same or analogous features or elements of the invention.

DETAILED DESCRIPTION OF THE INVENTION

Reference now will be made in detail to the embodiments of the invention, one or more examples of which are set forth below. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment, can be used on another embodiment to yield a still further embodiment. Thus, it is intended that the present invention cover such modifications and variations as come within the scope of the appended claims and their equivalents. Other objects, features and aspects of the present invention are disclosed in or are obvious from the following detailed description. It is to be understood by one of ordinary skill in the art that the present discussion is a description of exemplary embodiments only, and is not intended as limiting the broader aspects of the present invention.

In general, the present invention is directed to a fire assembly that can be more easily installed into a floor-ceiling assembly or wall assembly. In particular, a fire assembly of the present invention includes a recessed electrical fixture, such as a light fixture, enclosed within a housing, or fire box, such that the entire assembly can form an integral structure and be sold and installed as a single unit. Moreover, it has been discovered that a fire assembly of the present invention not only imparts some fire protection to the recessed electrical fixture, but can also maintain the fire rating of the floor-ceiling assembly or wall assembly.

Figure 7:
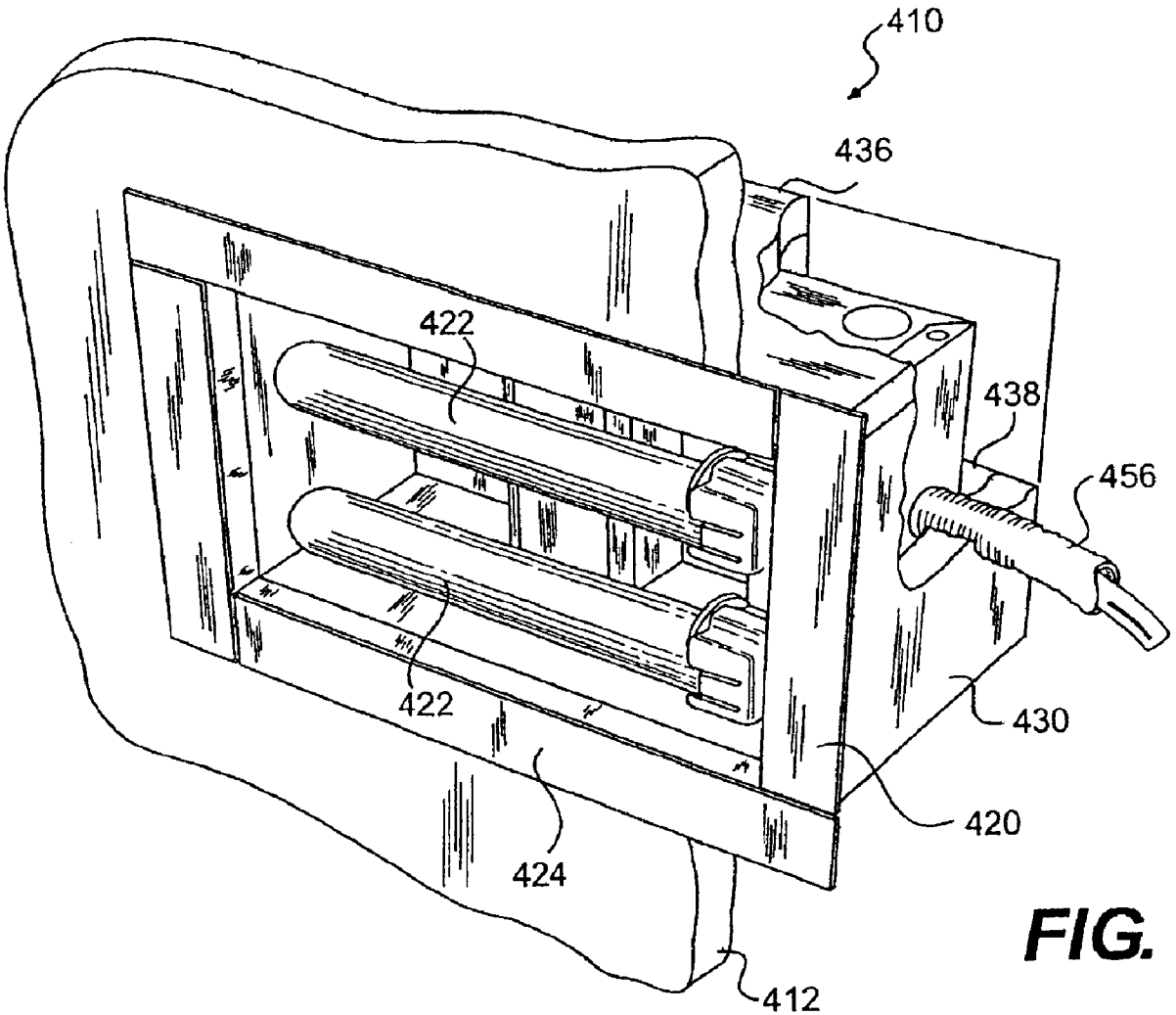
FIG. 7 is a perspective view with cutaway portions of another alternative embodiment of a fire assembly of the present invention.
Figure 8:
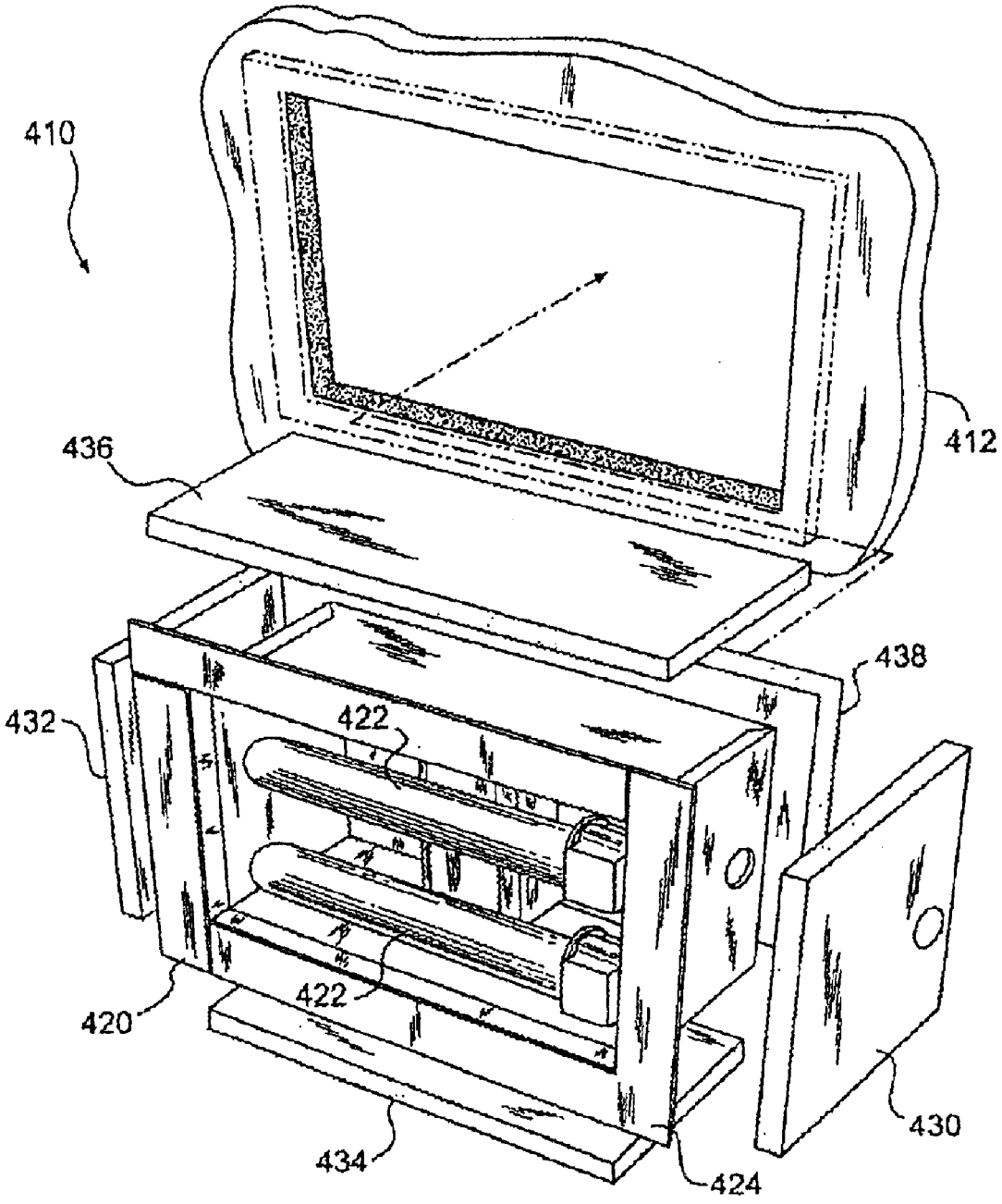
FIG. 8 is an exploded perspective view of the fire assembly shown in FIG. 7.
Figure 9:
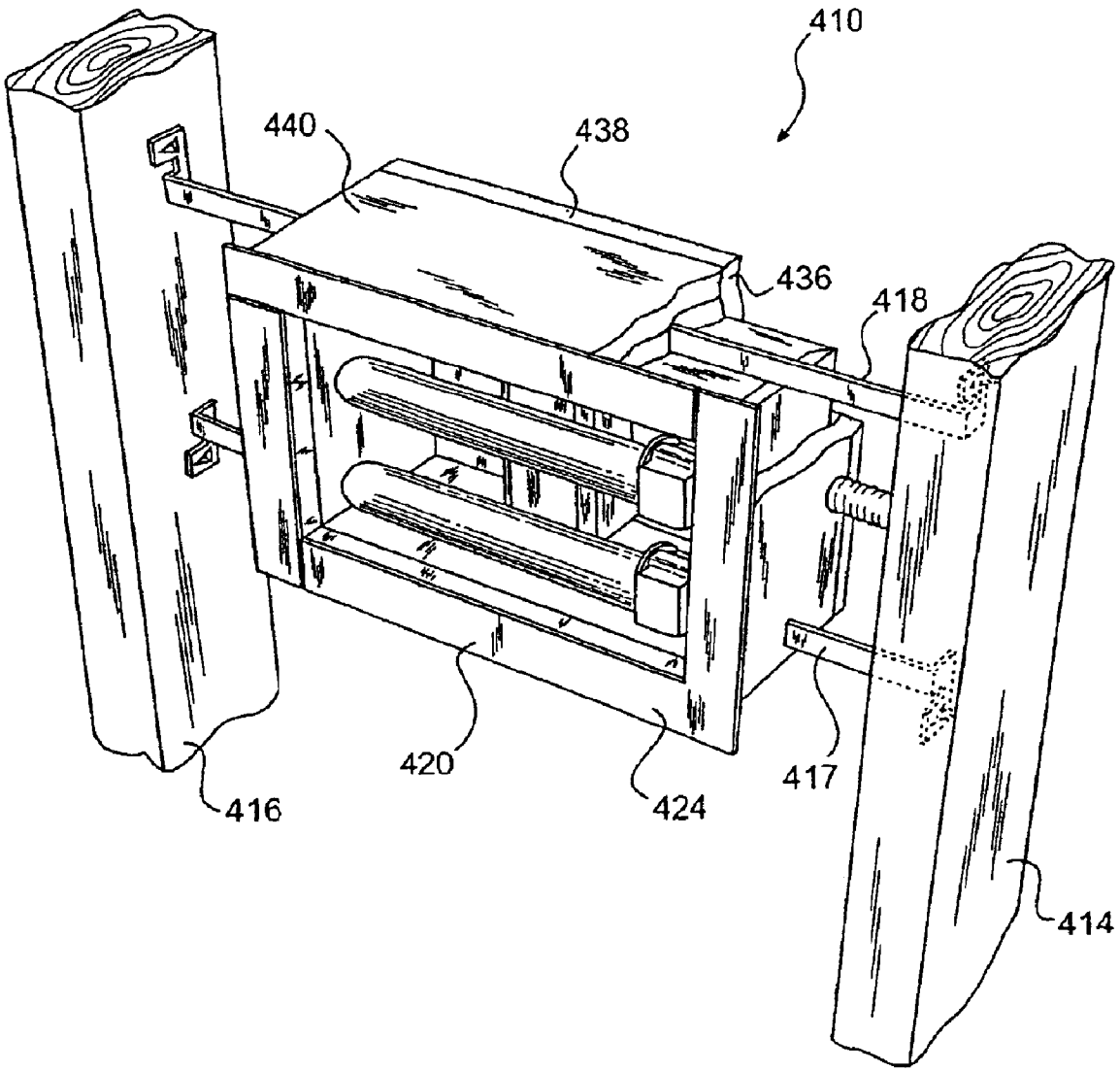
FIG. 9 is a perspective view with cutaway portions of another alternative embodiment of a fire assembly of the present invention.
Figure 10:
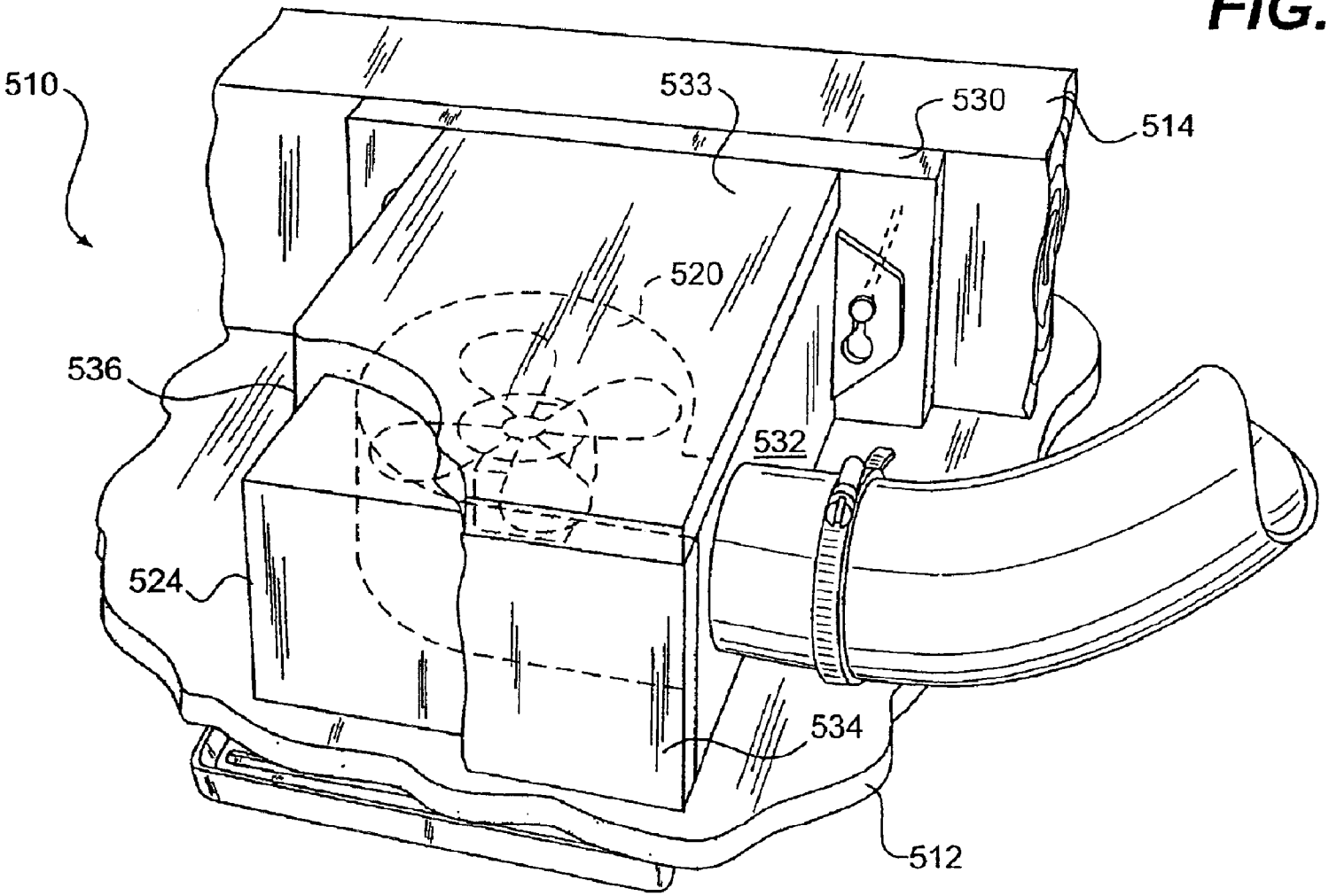
FIG. 10 is a perspective view with cutaway portions of still another alternative embodiment of a fire assembly made in accordance with the present invention.

Referring to the Figures, various embodiments of the present invention are shown. Specifically, FIGS. 1 through 5 show embodiments of fire assemblies particularly well suited for being installed in a floor-ceiling assembly. FIGS. 7 through 9, on the other hand, show embodiments of fire assemblies that are configured to be installed in a wall assembly. FIG. 10 is directed to a fire assembly containing a ventilation fan.

Figure 3:
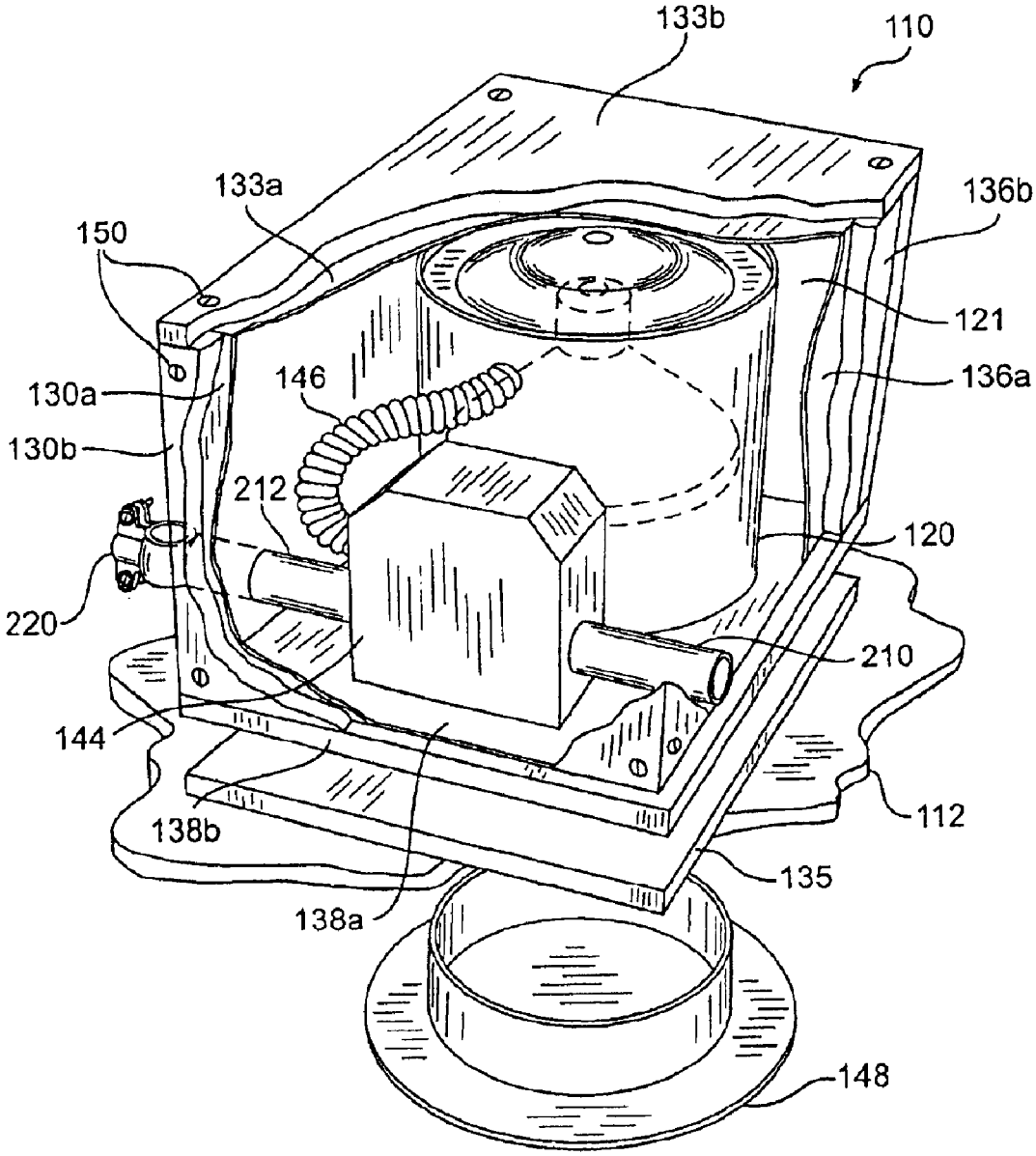
FIG. 3 is a perspective view with cutaway portions of an alternative embodiment of a fire assembly of the present invention.

Referring to FIG. 1, one embodiment of a fire assembly 10 of the present invention is depicted. As shown, fire assembly 10 includes a light fixture 20 contained within a housing formed by various fire-resistant walls. In general, light fixture 20 can include any type of light fixture known in the art, such as recessed light fixtures. In one embodiment, light fixture 20 can include a cylindrical reflector (or "can") having one or more incandescent or fluorescent lighting elements contained therein. For example, as shown in FIG. 3, a single incandescent lamp 121 can be contained within a light fixture 120 to distribute light below ceiling 112.

Light fixtures 20 or 120 can also generally have any of a variety of shapes and sizes. For instance, as shown in FIGS. 1–5, light fixture 20 can be formed such that it opens at the ceiling surface and is recessed thereabove. Moreover, as shown, light fixture 20 can have a substantially cylindrical shape defining a circular opening at its bottom section and being enclosed at its top section. Other suitable forms of recessed light fixtures that can be used in the present invention include, but are not limited to, the fixtures described in U.S. Pat. No. 5,758,959 to Sieczkowski; U.S. Pat. No. 5,857,766 to Sieczkowski; and U.S. Pat. No. 6,004,011 to Sieczkowski. In addition, recessed lighting fixtures of the present invention can contain any of a variety of types and shapes of light elements or lamps. For example, the recessed lighting fixture can have a shape that is round, square, rectangular, etc. Moreover, the lighting element can also contain different types of lamps, such as incandescent, fluorescent, High Intensity Discharge (AHID@), etc.)

In accordance with the present invention, the fire assembly can also generally include a housing used to enclose the light fixture. Depending on the particular application, the housing can be physically separated from or integrally connected to the recessed lighting fixture. Thus, a fire assembly of the present invention can be sold and installed as a single, integral unit, or can also be sold and installed as separate units. When physically separated, the housing and recessed lighting fixture may or may not be later attached during installation. It should be understood that although the use of a housing that is separate from the recessed lighting fixture can provide many benefits, it is typically preferred that the fire assembly be formed as an integral unit.

Referring to FIG. 1, for instance, a housing of the present invention can include four side walls 30, 32, 34, and 36. Each of the four side walls can be formed into a cube-shaped fire box by attaching a top and/or bottom wall thereto. Although the housing is depicted and described herein as having a cube shape (e.g. box), it should be understood that a housing of the present invention can also have any other shape or dimension, and contain any number of walls, so long as the housing extends from the ceiling to form a substantially continuous surface therewith. For example, in an alternative embodiment, the housing can have a cylindrical shape.

Figure 2:
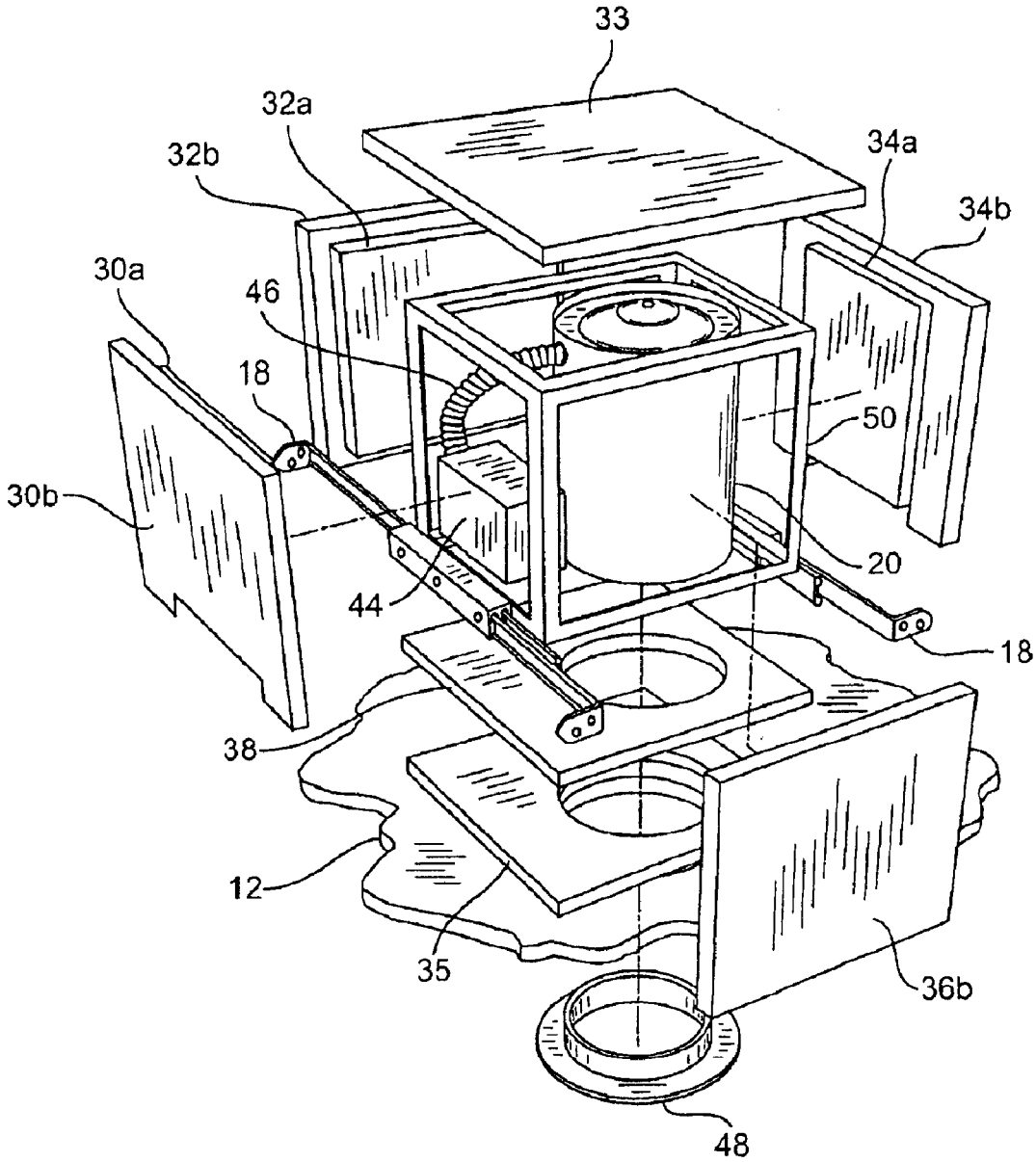
FIG. 2 is an exploded perspective view of the fire assembly depicted in FIG. 1.

As shown in FIG. 2, a top wall 33 can be placed above light fixture 20 and attached to the side walls by any method known in the art. Moreover, a bottom wall 38 can be placed under light fixture 20 and further attached to the side walls by any method known in the art. As illustrated, bottom wall 38 can define a circular opening corresponding to the cylindrical reflector of the light fixture so that light fixture 20 can distribute light therethrough. In some embodiments, as shown in FIGS. 1–3, a decorative flange 48 (148 in FIG. 3) can also be inserted into the opening of bottom wall 38 (138 in FIG. 3) to attach to light fixture 20 (120 in FIG. 3) and improve the aesthetics of the fire assembly.

In general, the housing walls of the present invention can be made from any of a variety of materials. Examples of generally fire-resistant materials include, but are not limited to, dry wall or wallboard (e.g. sheet rock, plywood, asbestos cement sheets, gypsum plasterboard, laminated plastics, etc.), and plaster. In particular, a housing wall of the present invention typically comprises at least one material that is generally fire-resistant, although the wall may also contain other materials that are not fire-resistant. For instance, in one embodiment, as shown in FIG. 1, side walls 30, 32, 34, 36; bottom wall 38; and the top wall (not shown), can comprise a dry wall or wallboard material. However, it should be understood that the fire box walls need not comprise the same material.

The present inventors have discovered that optimum fire resistant results are obtained from the structure of the present invention. In particular, it is believed that the great fire resistant properties obtained are the result of a combination of elements. In one embodiment, those elements are using rigid panels made from the fire resistant materials described above and placing the panels on the exterior of the light fixture to facilitate the formation of a continuous surface with an adjacent wall or ceiling. Also of importance is the manner in which the fire resistant panels or walls are attached together. The panels or walls should be securely attached together using a mechanical device, such as screws, or an adhesive. Further, the intersection points of the panels can be sealed if desired using a fire resistant sealant, such as a tape, caulking or putty.

In some embodiments, one or more walls of the housing can also comprise multiple layers of material. In general, each layer of a multi-layered wall can comprise any of a variety of fire-resistant and/or non-fire-resistant materials. For instance, referring to FIG. 2, one embodiment of the present invention includes a fire box having walls made from two layers of dry wall. As shown, side wall outer layers 30*b* 32*b*, 34*b*, and 36*b* can be attached to dry wall, side wall inner layers 30*a*, 32*a*, 34*a*, and 36*a* (not shown), respectively. In this embodiment, the inner layers of material have smaller dimensions than the outer layers attached thereto. Although not required, such smaller dimensions can often minimize the amount of material required, and thus, decrease manufacturing costs.

In addition, besides generally fire-resistant materials, a wall of the present invention can also contain other materials, such as aluminum, to help ensure that the fire rating of the floor-ceiling assembly is maintained. Referring to FIG. 3, another embodiment of a multi-layered housing of the present invention is depicted. In this embodiment, fire assembly 110 includes a fire box having four side wall inner layers 130*a*, 132*a*, 134*a*, and 136*a*, as well as top wall inner layer 133*a* and bottom wall inner layer 138*a*, each of which are made from aluminum. The aluminum housing forms a support structure for the outer layers. The aluminum walls also act as a heat shield for the lamp. As shown, each aluminum wall can be attached to a corresponding sheet rock layer to provide a multi-layered fire box structure. For example, side wall inner layer 130*a* can be attached to a side wall outer layer 130*b* made from dry wall. Moreover, although not specifically depicted, the aluminum inner layers can also be attached to a metal frame or other structure.

When multiple layers are utilized to form one or more walls of a fire box of the present invention, any suitable method of attachment known in the art can be used for attaching the layers. For instance, in one embodiment, an adhesive can be used to attach the layers. Moreover, in another embodiment, the layers can be attached mechanically through screws or other types of fasteners. For example, as shown in FIG. 3, screws 150 can be utilized to attach together the layers of each wall, as well as the walls themselves.

Regardless of the number of layers utilized, a fire wall of the present invention can generally have any desired thickness. For instance, a thicker fire wall can sometimes provide better fire protection, while a thinner fire wall can often lower production costs. In one embodiment, for example, a ⅝" layer of sheet rock can be utilized to form a fire assembly of the present invention. In another embodiment, two ⅝" layers of sheet rock can be utilized.

According to the present invention, as mentioned above, the fire assembly can also contain a support structure for attaching to a light fixture. Although not required, a support structure of the present invention can help ensure that the light fixture remains stable within the fire assembly. In general, a support structure of the present invention can have any shape or dimension, or comprise any material, so long as such structure is capable of effectively attaching to a light fixture. As shown in FIG. 2, one embodiment of the present invention includes support structure 50 that can be utilized to stabilize the movement of light fixture 20 within fire assembly 10. In this embodiment, for example, support structure 50 is a metal frame to which light fixture 20 can be attached by any method known in the art. As stated, it should be understood that a support structure of the present invention need not be a frame, and that the support structure can also have a variety of other shapes, such as the aluminum housing illustrated in FIG. 3.

When utilized, the support structure is typically attached to the walls of the fire box such that a fire assembly having an integral structure can be formed. For instance, as shown in FIG. 1., the fire box walls can be attached by any method known in the art to support frame 50. Moreover, as shown in FIG. 3, outer wall layers 130*b*, 132*b* (not shown), 133*b*, 134*b* (not shown), 136*b*, and 138*b*, can be attached via screws 150 to inner wall layers 130*a*, 132*a* (not shown), 133*a*, 134*a* (not shown), 136*a*, and 138*a*, respectively. It should be understood, however, that a support structure is not required to attach the light fixture to the fire box walls, as long as the overall fire assembly forms an integral structure. In fact, the light fixture could be directly affixed to one or more of the fire box walls, or attached thereto through some other mechanism besides a support structure.

In some embodiments, various mechanisms can be utilized to minimize the transfer of heat through the fire assembly to further ensure that the fire rating of the floor-ceiling assembly is adequately maintained. For example, in one embodiment, a gasket material can be inserted between the bottom wall of the fire box and the ceiling. In general, the gasket material can comprise any of a variety of materials, such as fiberglass, foam, rubber, etc. For instance, in one embodiment, as shown in FIGS. 1–2, a fiberglass gasket 35 can be inserted between bottom wall 38 and ceiling surface 12. As shown, gasket 35 can define a hole that corresponds with the hole of bottom wall 38 and the diameter of light fixture 20.

In addition, a fire assembly of the present invention can also be equipped with any mechanism to attach the fire assembly to a floor-ceiling assembly. For example, in one embodiment, one or more bar hangers can be used to attach the fire assembly to a ceiling joist. For instance, as shown in FIGS. 1–2, bar hangers 18 can be affixed to support structure 50 by any suitable attachment mechanism, such as screws or other fasteners. As shown, bar hangers 18 are adjustable such that they can extend to attach to opposing ceiling joists 14 (one of which is shown in FIG. 1). It should be understood, however, that the fire assembly may be constructed, and may attach to the ceiling, in any suitable manner. For example, the brackets may attach to T-bars rather than joists.

In most embodiments, a junction box can also be provided to allow an electrician or other suitable technician to correctly wire the light fixture. For instance, as shown in FIG. 2, wires from light fixture 20 can be placed in electrical communication with junction box 44 through conduit 46. Conduit 46 can generally be made from any material, such as flexible or rigid pipes, capable of safely enclosing electrical wires contained therein. In some embodiments, junction box 44 can be mounted to the bottom wall of the fire box such that it remains stationary with respect thereto, while in other embodiments, junction 44 can be allowed to hang free (not shown). Furthermore, although not depicted, some embodiments of the present invention can also provide for the attachment of junction box 44 to light fixture 20.

In addition, referring to FIG. 3, another embodiment of the present invention also includes one or more conduits to facilitate the electrical attachment of the fire assembly to other assemblies or light fixtures. As shown, junction box 144 can be provided with conduits 210 and 212 extending in a substantially planar direction from junction box 144. In one embodiment, for example, the conduits can comprise 2" IP piping. In general, conduits of the present invention can function to hold wires for electrically attaching one fire assembly to another fire assembly or light fixture. In particular, a clamp 220 can be attached to conduit 212, for example, such that conduit 212 can be connected to another conduit of another fire assembly or recessed light fixture. The screws of clamp 220 can be tightened or loosened such that the clamp is capable of better attaching conduit 212 to another conduit. One example of a clamp that is suitable for use in the present invention is a AROMEX@ clamp. It should be understood, however, that the present invention is not limited to the use of clamps, and that any other suitable connection device, such as plugs, can be used.

In some embodiments, it may be necessary to seal the conduits to ensure fire safety. For example, as shown in FIG. 3, a portion of the conduit can sometimes extend outside fire assembly 110. Thus, in order to ensure fire safety compliance, it may be desired to seal those portions of the conduit located outside the assembly. For instance, sealants, such as joint dry wall compound, joint tape, or combinations thereof, can be used to seal the portions of the conduit extending outside of the fire assembly. In addition, it may also be desired to seal the opening in the fire box wall through which a conduit is inserted. In particular, the point at which the conduits extend through the walls of the fire box walls can be sealed by any method known in the art, including, for example, fire caulking.

Figure 4:
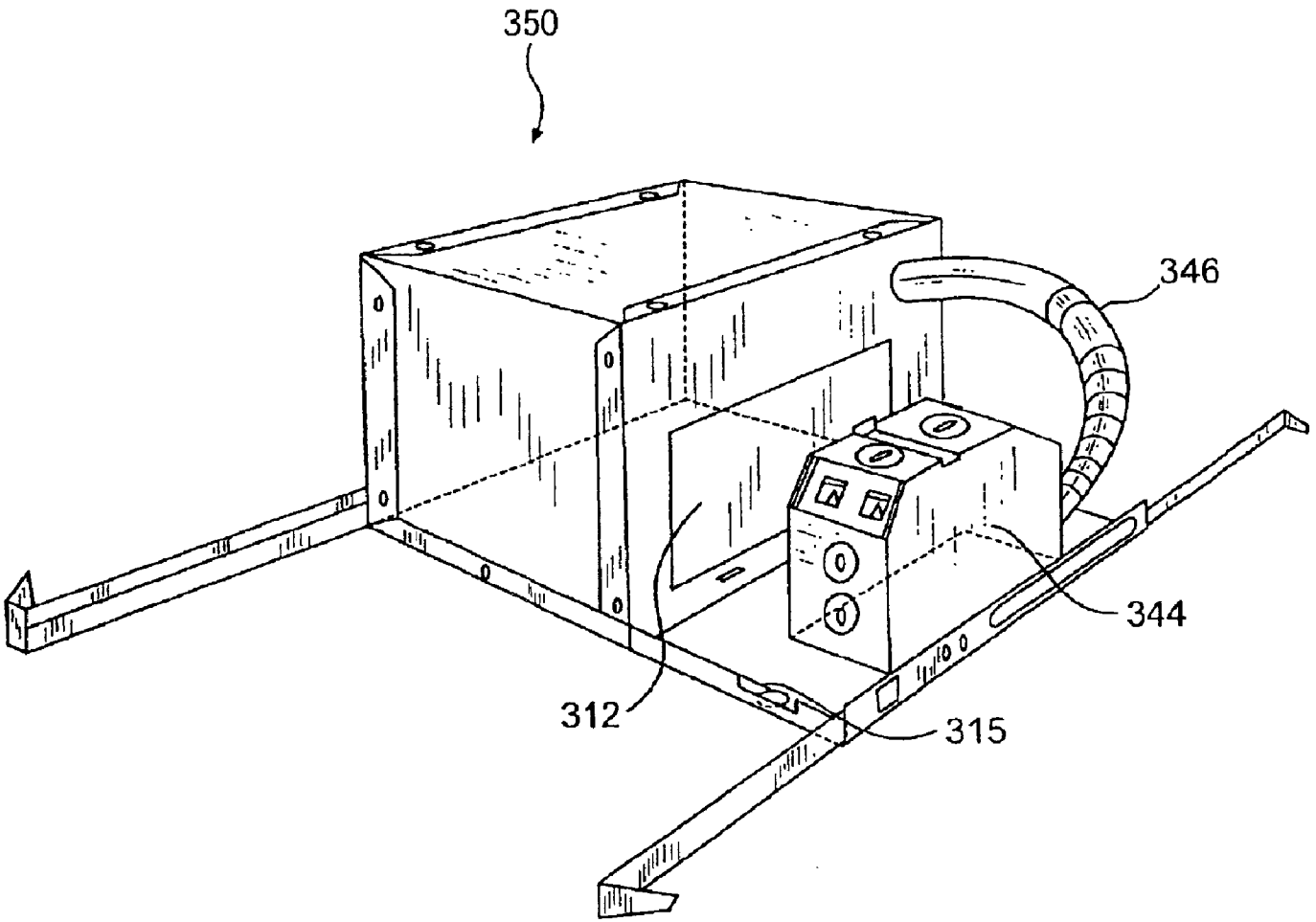
FIG. 4 is a perspective view of a support structure that may be used in the fire assembly of the present invention.
Figure 5:
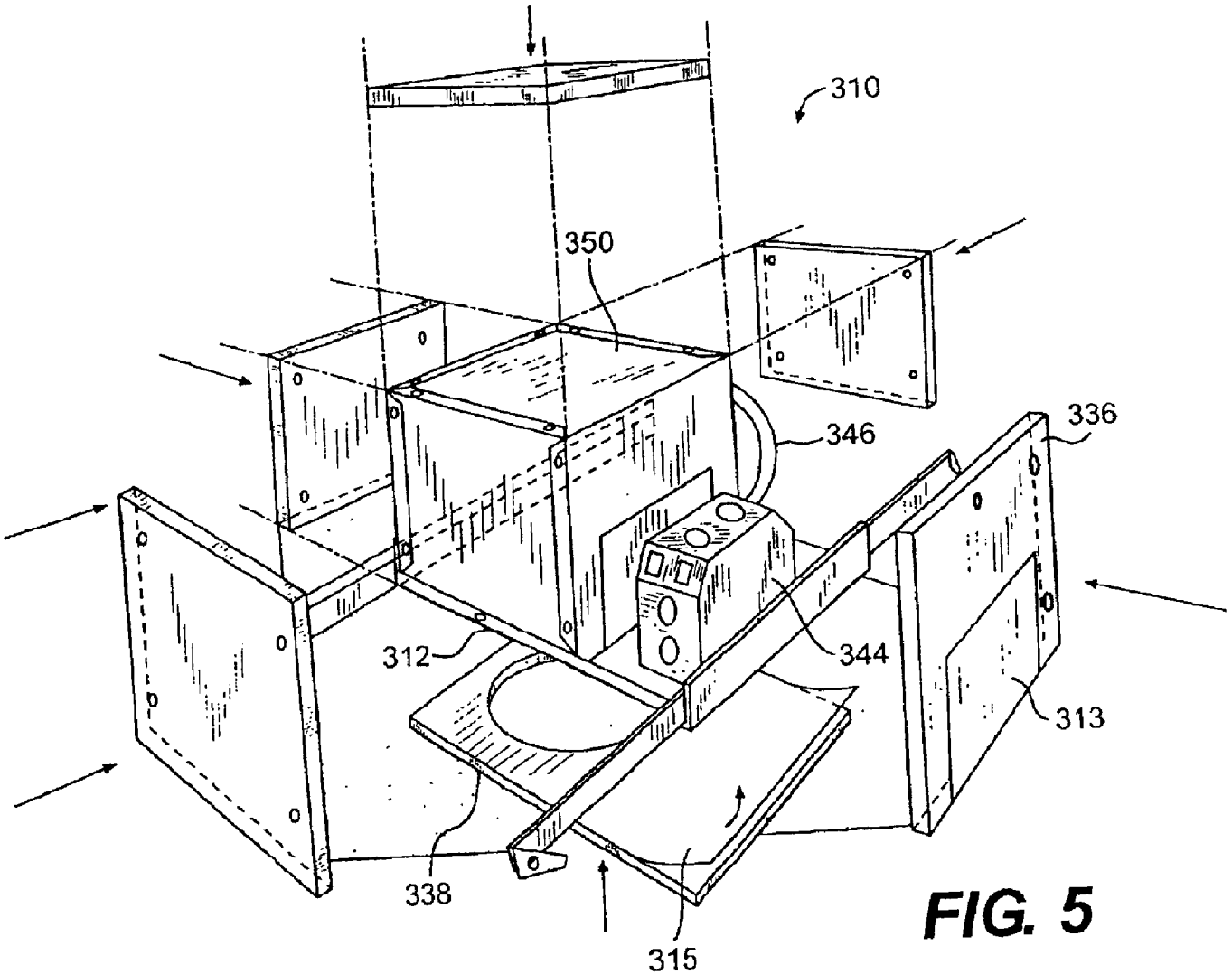
FIG. 5 is an exploded perspective view of another alternative embodiment of a fire assembly of the present invention incorporating the support structure illustrated in FIG. 4.

In accordance with the present invention, a fire assembly of the present invention can also include various mechanisms to provide access to the light fixture and/or junction box for wiring by an electrician. For instance, FIGS. 4 and 5 are directed to a further embodiment of a fire assembly generally 310 made in accordance with the present invention. In particular, FIG. 5 is an exploded view of the entire fire assembly, while FIG. 4 illustrates a support structure generally 350 incorporated into the fire assembly. In this embodiment, support structure 350 includes a bottom plate 315 extending outwardly from bottom wall 338. As shown, the fire assembly can include a junction box 344 positioned on plate 315 to provide an electrician with easy access thereto. Junction box 344 can be placed in electrical communication with the light fixture (not shown) by conduit 346. Conduit 346 can extend through a fire box wall and through the support structure. As stated above, such an opening can be appropriately sealed using any sealing methods known in the art.

In some embodiments, a fire assembly of the present invention can also include at least one fire box wall equipped with a door or other mechanism capable of opening and closing. For instance, as shown in FIGS. 4–5, fire box assembly 310 can include a door 312 in support structure 350 and a corresponding door 313 in wall 336 that can be utilized by a technician to access the junction box from the light fixture. In particular, doors 312 and 315 can remain closed until access is required so that proper wire connections for the lighting fixture and junction box are maintained.

Referring to FIGS. 7 and 8, an alternative embodiment of a fire box assembly generally 410 made in accordance with the present invention is shown. In this embodiment, the fire box assembly 410 is particularly adapted to be mounted into a wall assembly, such as behind a wall 412. Various recessed electrical fixtures are designed as wall mount assemblies. For example, in the embodiment shown in FIGS. 7 and 8, the fire assembly 410 includes a wall mounted light fixture 420 which can be, for instance, a step light or a sconce housing.

As shown, the light fixture 420 includes a pair of fluorescent lamps 422 mounted in a housing 424, such as a metal housing.

In accordance with the present invention, the light fixture 420 is surrounded by a plurality of fire resistant panels that form a fire box. The fire resistant panels can be integral with the housing 424 and can form a substantially continuous fire resistant surface with the wall 412.

Specifically, the housing 424 of the light fixture 420 is surrounded by fire resistant panels 430, 432, 434, 436, and 438. The fire resistant panels can be made from any suitable fire resistant material. For instance, in one embodiment, the panels can be made from a rigid fire resistant material, such as sheetrock.

The panels 430, 432, 434, 436 and 438 can be attached together using any suitable securing means. For instance the panels can be mechanically connected together using, for instance, screws or can be adhesively secured together. Further, if necessary, fire resistant sealants can be applied where each of the panels converge. For instance, the corners formed by the panels can be sealed using a fire resistant tape or a fire resistant caulking.

Likewise, the panels can be attached to the light fixture housing 424 using a mechanical attachment device or an adhesive.

As shown in the embodiment illustrated in FIGS. 7 and 8, the fire resistant panels of the present invention are placed solely on the exterior side of the housing 424. It has been discovered by the present inventors, that better fire resistance is created when using the rigid panel materials as described above and when placing the panels on the exterior of the housing 424. If the panels are placed on the interior of the housing, the panels will be more difficult to attach to the housing and may interfere with the operation of the light fixture. Further, placing the panels on the outside of the housing creates a better continuous surface with the wall 412. For example, if the panels were placed on the interior of the housing, the panels would not contact the wall 412 due to the presence of the flange located around the perimeter of the housing 424.

As shown in FIG. 7, the firebox of the present invention can also accommodate electrical wires and other appendages that originate from the light fixture. For example, as shown, an electrical wire 456 originating from the light fixture 420 is shown extending through the fire resistant panel 430. If desired, a fire resistant putty or caulking can be applied around the passage formed in the panel 430 to maintain the fire rating of the assembly.

In order to mount the fire assembly 410 including the light fixture 420 into a wall assembly, the assembly can include various attachment devices. For example, as shown in FIG. 9, the fire assembly 410 can include a pair of bar hangers 417 and 418. The bar hangers are designed to be attached to a pair of wall beams 414 and 416. In this embodiment, the bar hangers 417 and 418 are connected to the metal housing 424 of the light fixture 420. As shown, on the top of the light fixture, a first fire resistant panel 436 is placed surrounding the bar hanger 418. In order to ensure that the fire rating is maintained, a second fire resistant panel 440 is then placed on top of the fire resistant panel 436 in order to form the firebox. A similar construction can be included on the bottom of the fire assembly 410.

Besides light fixtures, the present invention can also be used in connection with other electrical fixtures. For instance, referring to FIG. 10, a fire assembly 510 is shown that includes a fan assembly 520. In this embodiment, the fire assembly containing the fan assembly is shown mounted on a ceiling 512. It should be understood, however, that the fire assembly 510 can also be mounted on a wall if desired in accordance with the present invention.

As shown, in accordance with the present invention, the fan assembly 520 is surrounded by a metal housing 524 which, in turn, is surrounded by a firebox made in accordance with the present invention. The firebox includes fire resistant panels 530, 532, 533, 534, and 536. The fire resistant panels form a continuous surface with the ceiling 512 and are made from, in this embodiment, the same type of materials. For instance, ceiling 512 and the fire resistant panels 530, 532, 533, 534, and 536 can all be made from a rigid material, such as sheetrock. Similar to the other embodiments, the fire resistant panels are placed on the outside of the housing 524 and are connected together using mechanical attachment devices or using an adhesive.

Figure 11:
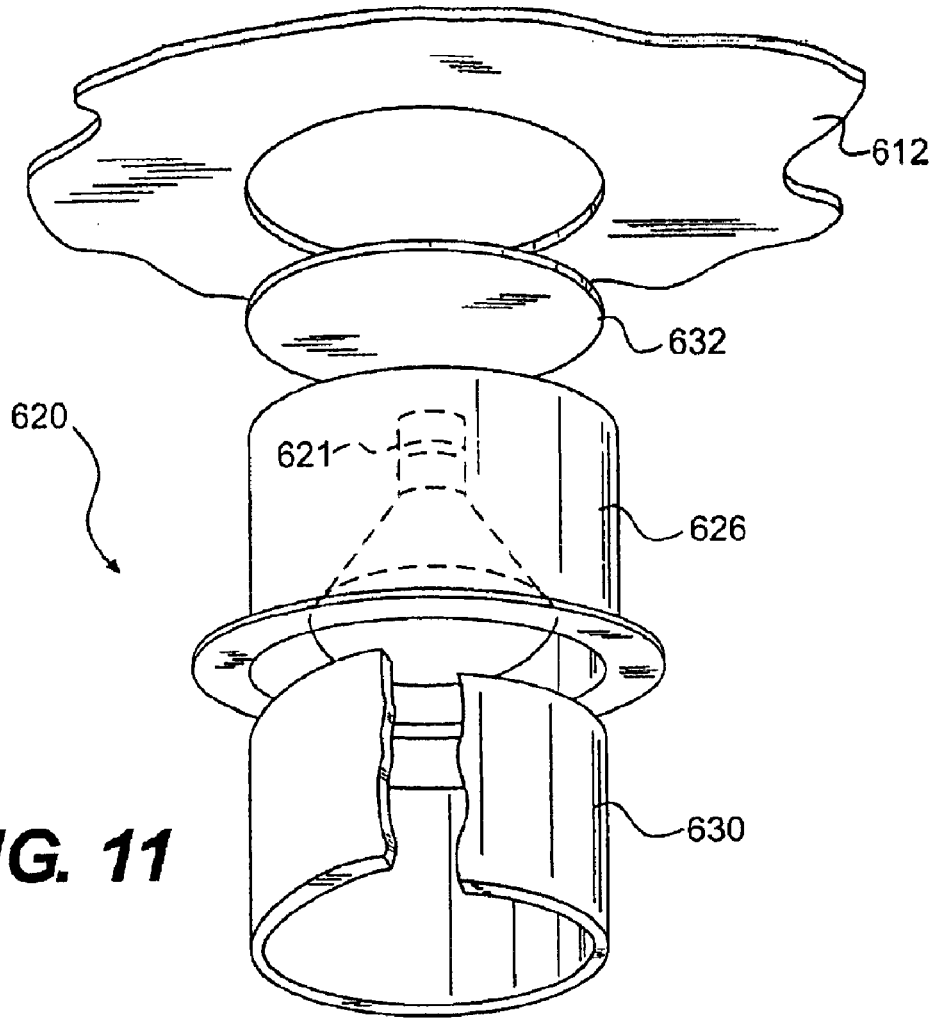
FIG. 11 is an exploded perspective view of another alternative embodiment of a fire assembly made in accordance with the present invention.
Figure 12:
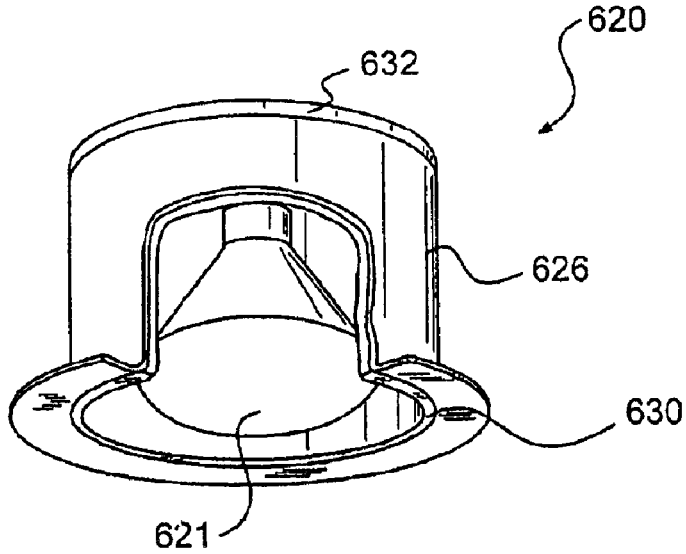
FIG. 12 is a perspective view with cutaway portions of the fire assembly illustrated in FIG. 11.

A still further alternative embodiment of the present invention is shown in FIGS. 11 and 12. In this embodiment, a recessed light fixture 620 is illustrated that can be mounted into a ceiling or wall 612. The light fixture 620 includes an incandescent lamp 621 surrounded by a light can 626. Light can 626 is used to direct the light being admitted by the incandescent lamp 621.

In this embodiment, a fire resistant material 630 is placed on the inside surface of the light can 626. Consequently, in this embodiment, instead of placing the fire resistant material on the outside of a housing surrounding the light fixture, the fire resistant material is actually placed inside as part of the light fixture itself. As shown, besides the fire resistant material 630, another fire resistant panel 632 can be placed on top of the light can 626. The fire resistant panel 632 can be placed on the exterior of the light can 626 as shown in FIGS. 11 and 12 or can be placed on the interior if desired.

In this embodiment, the fire resistant material must either be premolded to the shape of the light can 626 or can be made from a flexible material, such as fire putty.

The present invention may be better understood by reference to the following example.

EXAMPLE

The ability of a fire assembly of the present invention to maintain the fire rating of a floor-ceiling assembly was demonstrated. Initially, a fire assembly was formed as described above. In particular, a cube-shaped housing was formed by attaching four side walls and a top wall. Each wall contained sheet rock as the generally fire resistant material. The cube-shaped housing was then attached to a metallic support structure. To complete the fire assembly, the support structure and housing were subsequently attached to an incandescent recessed lighting fixture to form the fire assembly.

Figure 6:
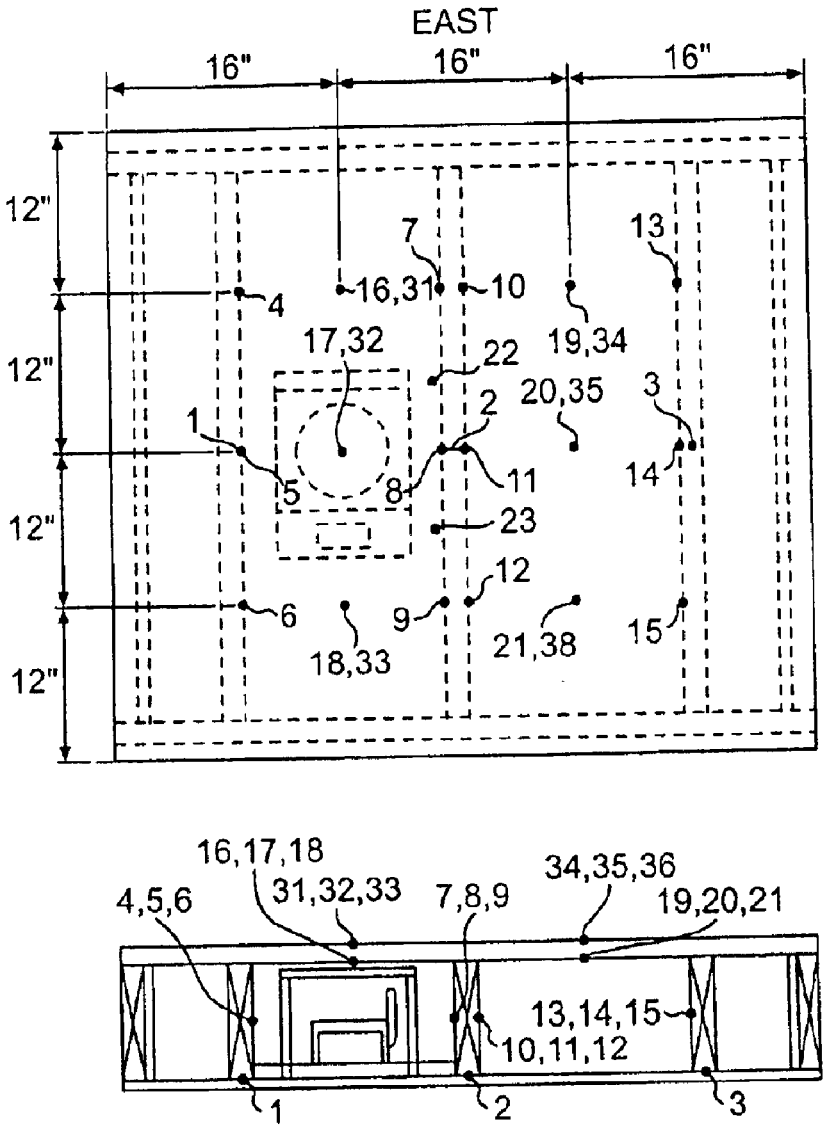
FIG. 6 is a top view and a side view of a floor-ceiling assembly used in the Example.

Once formed, the fire assembly was then tested according to UL standards. In particular, a 48-inch by 48-inch small scale floor-ceiling assembly was constructed as described in Design No. L501, which is set forth in UL=s 1999 Fire Resistance Directory and illustrated in FIG. 6. As shown in FIG. 6, the fire assembly was installed in a joist cavity while an adjoining joist cavity remained unchanged. As also shown in FIG. 6, various thermocouples were then positioned within the floor-ceiling assembly.

The small scale floor-ceiling assembly and fire assembly were then fire tested in accordance with the Standard, ANSI/UL 263 (ASTM E 119), as described in UL=s 1999 Fire Resistant Directory. In particular, the fire test included exposing the floor-ceiling assembly to an open flame evenly distributed across the ceilings surface. During testing, the temperatures at several locations on the lumber joists and on the underside of the plywood flooring in each of the two joist cavities were measured according to the thermocouple locations indicated in FIG. 6. The test was conducted for a period of approximately 1 hour. During testing, the temperature of the joist cavity where the fire assembly of the present invention was installed was compared to the temperature of the joist cavity containing no such fixture. In order to pass the fire test, it is necessary that the temperatures measured in the joist cavity with the recessed incandescent light fixture be no more than 5% hotter than the temperatures measured in the joist cavity without the light fixture.

After the period of fire exposure, it was determined that the fire assembly of the present invention adequately complied with the applicable UL standard. In fact, it was unexpectedly discovered that the joist cavity containing the recessed light fixture actually remained cooler than the adjoining joist cavity. Although unknown, it is believed that the fire assembly of the present invention provides more surface area in order to dissipate the heat.

These and other modifications and variations to the present invention may be practiced by those of ordinary skill in the art, without departing from the spirit and scope of the present invention, which is more particularly set forth in the appended claims. In addition, it should be understood that aspects of the various embodiments may be interchanged both in whole or in part. Furthermore, those of ordinary skill in the art will appreciate that the foregoing description is by way of example only, and is not intended to limit the invention so further described in such appended claims.

What is claimed is:

1. A light assembly comprising:

a light fixture adapted to be positioned relative to an opening defined in a surface of a structure, and further adapted to allow light to be projected through said opening; and a housing substantially enclosing said light fixture, said housing and said light fixture forming a preassembled integral unit, said housing including at least one generally fire-resistant material, said at least one generally fire-resistant material forming a substantially continuous surface with said surface of said structure.

2. A light assembly according to claim 1, wherein said structure includes a floor-ceiling assembly, said floor-ceiling assembly has a fire rating, and said housing is capable of substantially maintaining said fire rating after said light assembly is installed.

3. A light assembly according to claim 1, wherein said housing includes a bottom wall and another wall, a portion of said bottom wall extending beyond an intersection of said bottom wall and said another wall of said housing, said portion having upper and lower surfaces and a junction box positioned on said upper surface of said portion.

4. A light assembly according to claim 3, wherein a gasket is positioned between said bottom wall and said surface of said structure.

5. A light assembly according to claim 1, wherein said at least one generally fire resistant material is selected from the group consisting of dry wall, plaster, and combinations thereof.

6. A light assembly according to claim 1, wherein said housing further including a support structure formed from aluminum.

7. A light assembly according to claim 6, wherein said support structure is mechanically coupled to said at least one generally fire resistant material and said light fixture.

8. A light assembly according to claim 6, wherein said support structure defines an interior surface facing said light fixture and an exterior surface, substantially all of said at least one generally fire resistant material being located adjacent said exterior surface.

9. A light assembly according to claim 8, wherein said support structure includes a metallic enclosure.

10. A light assembly according to claim 1, further comprising a junction box adapted to be electrically connected to said light fixture.

11. A light assembly according to claim 10, further comprising at least one conduit extending from said junction box, and being capable of electrically coupling said light fixture to at least one other light fixture.

12. A light assembly according to claim 10, wherein said junction box is located within said housing.

13. A light assembly according to claim 1, further comprising an attachment member connected to said housing, and being configured to attach said light assembly to said structure.

14. A light assembly according to claim 13, wherein said attachment member includes a bar hanger.

15. A light assembly according to claim 1, wherein said housing is substantially cylindrical.

16. A method of installing a light assembly comprising the steps of forming a preassembled integral light unit including a lamp fixture and a housing substantially surrounding the lamp fixture, the housing including a generally fire-resistant material, and installing the integral light unit behind an opening in a surface of an adjacent structure, the housing forming a substantially continuous surface with the surface of the adjacent structure.

17. A method according to claim 16, wherein the forming step includes forming the preassembled integral light unit to include a support structure having an exterior surface and an interior surface.

18. A method according to claim 17, wherein the forming step includes forming the preassembled integral light unit so that the generally fire-resistant material is adjacent the exterior surface of the support structure.

19. A method according to claim 18, wherein the forming step includes forming a substantially cylindrical preassembled integral light unit.

20. A recessed light fixture comprising:

a light fixture adapted to be installed behind a surface of an adjacent structure; and a housing substantially surrounding said light fixture, such that said housing and said light fixture form a preassembled integral unit, said housing including a first and a second layer, at least one of said first layer and said second layer being formed from a generally fire-resistant material, and at least one of said first layer and said second layer being adapted to form a substantially continuous surface with the surface of the adjacent structure when installed therebehind.

21. A recessed light fixture according to claim 20, wherein said first layer forms an interior layer and said second layer forms an exterior layer.

22. A recessed light fixture according to claim 21, wherein said first layer is formed from aluminum.

23. A recessed light fixture according to claim 21, wherein said fire-resistant material is said second layer.

24. A recessed light fixture according to claim 23, wherein said first layer is formed from aluminum.

25. A light assembly comprising:

a light housing;

a recessed lighting fixture within said light housing;

a fire resistant housing surrounding said light housing, said fire resistant housing having a plurality of side walls, a top wall, and a bottom wall, said bottom wall having an opening adapted to receive a portion of said light housing, wherein said fire resistant housing and said light housing form a pre-assembled integral unit and each of said side walls and said top wall of said fire resistant housing include a generally fire resistant material; and a gasket on said bottom wall of said fire resistant housing, said gasket having a hole therein that substantially aligns with said opening in said bottom wall.

26. A light assembly according to claim 25, wherein said light housing has an enclosed top, an open bottom, and reflective sides therebetween.

27. A light assembly according to claim 26, wherein said reflective sides are substantially cylindrical between said enclosed top and said open bottom.

28. A light assembly according to claim 25, wherein said generally fire resistant material is supported by a metal structure.

29. A light assembly according to claim 28, wherein said metal structure is aluminum.

30. A light assembly according to claim 25, wherein said fire resistant housing is generally rectangularly shaped.

31. A light assembly according to claim 25, wherein said fire resistant housing is generally cube-shaped.

32. A light assembly according to claim 25, wherein said gasket is formed from fiberglass.

33. A light assembly according to claim 25, further comprising adjustable bar hangers secured to said bottom of said fire resistant housing.

34. A light assembly according to claim 25, further comprising an electrical junction box in electrical communication with said lighting fixture.

* * * * *

US006838618C1

(12) INTER PARTES REEXAMINATION CERTIFICATE (778th)

United States Patent

Newbold et al.

(10) Number: US 6,838,618 C1

(45) **Certificate Issued: *Dec. 26, 2013**

(54) FIRE ASSEMBLY FOR RECESSED ELECTRICAL FIXTURES

(75) Inventors: Ronald Newbold, Roebuck, SC (US); Thomas T. White, Fayetteville, GA (US)

(73) Assignee: Hubbell Incorporated, Orange, CT (US)

Reexamination Request:
No. 95/000,124, Jan. 23, 2006

Reexamination Certificate for:

| | |
|---|---|
| Patent No.: | **6,838,618** |
| Issued: | **Jan. 4, 2005** |
| Appl. No.: | **10/702,725** |
| Filed: | **Nov. 7, 2003** |

( * ) Notice: This patent is subject to a terminal disclaimer.

Related U.S. Application Data

(63) Continuation of application No. 10/066,310, filed on Feb. 1, 2002, now Pat. No. 7,114,294, which is a continuation-in-part of application No. 09/520,382, filed on Mar. 8, 2000, now Pat. No. 6,357,891.

(51) Int. Cl.

| | |
|---|---|
| ***F21S 8/02*** | (2006.01) |
| ***F21V 15/06*** | (2006.01) |
| ***F21V 15/00*** | (2006.01) |
| ***F21V 25/00*** | (2006.01) |

(52) U.S. Cl.
USPC ..... 174/50; 174/17 VA; 174/480; 362/147; 362/365; 52/27

(58) Field of Classification Search
None
See application file for complete search history.

(56) References Cited

To view the complete listing of prior art documents cited during the proceeding for Reexamination Control Number 95/000,124, please refer to the USPTO's public Patent Application Information Retrieval (PAIR) system under the Display References tab.

*Primary Examiner* — Margaret Rubin

(57) ABSTRACT

A fire assembly that can be used for installing recessed electrical fixtures into various structures such as wall assemblies is provided. The fire assembly includes an electrical fixture contained within a generally fire-resistant housing. The housing can enclose the electrical fixture in such a manner that the resulting fire assembly has an integral structure. In some instances, a support structure can be utilized to attach the housing to the electrical fixture. Furthermore, the housing can be a cube-shaped box have a variety of generally fire-resistant walls. These walls can be made from materials such as sheet rock.

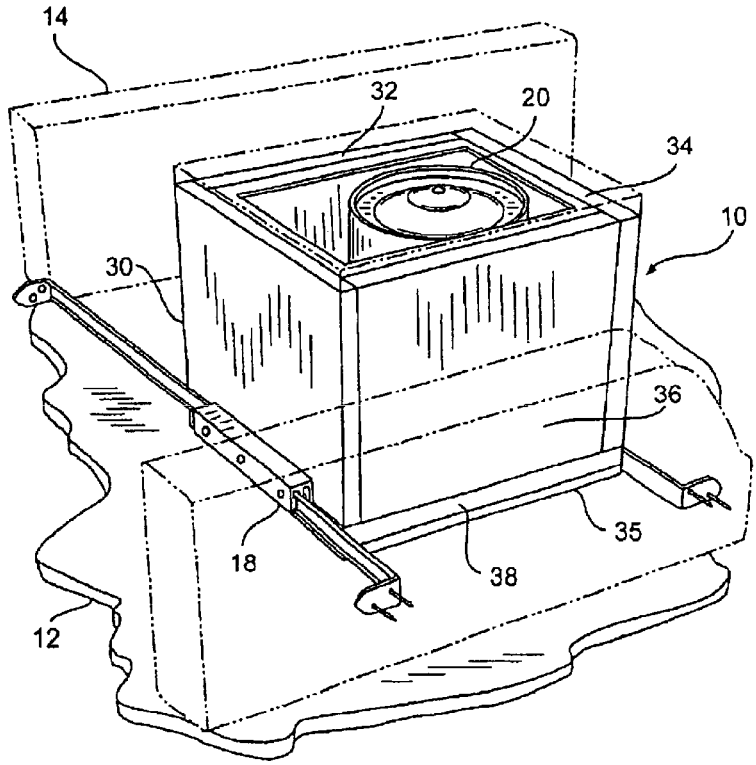

INTER PARTES REEXAMINATION CERTIFICATE ISSUED UNDER 35 U.S.C. 316

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 25-34 is confirmed.

Claims 1, 2, 10-13 and 15-24 are cancelled.

Claims 3, 5, 6 and 14 are determined to be patentable as amended.

Claims 4, 7, 8 and 9, dependent on an amended claim, are determined to be patentable.

3. A light assembly [according to claim 1] *comprising:*

*a light fixture adapted to be positioned relative to an opening defined in a surface of a structure, and further adapted to allow light to be projected through said opening; and*

*a housing substantially enclosing said light fixture, said housing and said light fixture forming a preassembled integral unit, said housing including at least one generally fire-resistant material, said at least one generally fire-resistant material forming a substantially continuous surface with said surface of said structure*, wherein said housing includes a bottom wall and another wall, a portion of said bottom wall extending beyond an intersection of said bottom wall and said another wall of said housing, said portion having upper and lower surfaces and a junction box positioned on said upper surface of said portion.

5. A light assembly [according to claim 1] *comprising:*

*a light fixture adapted to be positioned relative to an opening defined in a surface of a structure, and further adapted to allow light to be projected through said opening; and*

*a housing substantially enclosing said light fixture, said housing and said light fixture forming a preassembled integral unit, said housing including at least one generally fire-resistant material, said at least one generally fire-resistant material forming a substantially continuous surface with said surface of said structure*, wherein said at least one generally fire resistant material is selected from the group consisting of dry wall, plaster, and combinations thereof.

6. A light assembly [according to claim 1] *comprising:*

*a light fixture adapted to be positioned relative to an opening defined in a surface of a structure, and further adapted to allow light to be projected through said opening; and*

*a housing substantially enclosing said light fixture, said housing and said light fixture forming a preassembled integral unit, said housing including at least one generally fire-resistant material, said at least one generally fire-resistant material forming a substantially continuous surface with said surface of said structure*,

[wherein] said housing further including a support structure formed from aluminum.

14. A light assembly [according to claim 13] *comprising:*

*a light fixture adapted to be positioned relative to an opening defined in a surface of a structure, and further adapted to allow light to be projected through said opening;*

*a housing substantially enclosing said light fixture, said housing and said light fixture forming a preassembled integral unit, said housing including at least one generally fire-resistant material, said at least one generally fire-resistant material forming a substantially continuous surface with said surface of said structure, and*

*further comprising an attachment member connected to said housing, and being configured to attach said light assembly to said structure* wherein said attachment member includes a bar hanger.

* * * * *